US005497631A

United States Patent [19]

Lorentzen et al.

[11] Patent Number: 5,497,631

[45] Date of Patent: Mar. 12, 1996

[54] TRANSCRITICAL VAPOR COMPRESSION CYCLE DEVICE WITH A VARIABLE HIGH SIDE VOLUME ELEMENT

[75] Inventors: Gustav Lorentzen, Trondheim; Jostein Pettersen, Ranheim, both of Norway

[73] Assignee: Sinvent A/S, Trondheim, Norway

[21] Appl. No.: 256,181

[22] PCT Filed: Dec. 22, 1992

[86] PCT No.: PCT/NO92/00204

§ 371 Date: Jun. 27, 1994

§ 102(e) Date: Jun. 27, 1994

[87] PCT Pub. No.: WO93/13370

PCT Pub. Date: Jul. 8, 1993

[30] Foreign Application Priority Data

Dec. 27, 1991 [NO] Norway ..... 915127

[51] Int. Cl.[6] ..... F25B 41/00

[52] U.S. Cl. ..... 62/115; 62/174

[58] Field of Search ..... 62/174, 114, 401, 62/115

[56] References Cited

U.S. PATENT DOCUMENTS

| | | | |
|---|---|---|---|
| 2,241,086 | 5/1941 | Gould . | |
| 4,175,400 | 11/1979 | Edwards et al. | 62/174 |
| 4,290,272 | 9/1981 | Vakil . | |
| 4,546,616 | 10/1985 | Drucker | 62/174 |
| 5,118,071 | 6/1992 | Huelle | 251/11 |
| 5,245,836 | 9/1993 | Lorentzen et al. | 62/174 |

FOREIGN PATENT DOCUMENTS

| | | |
|---|---|---|
| 0370262 | 5/1990 | European Pat. Off. . |
| 898751 | 12/1953 | Germany . |
| 90/07683 | 7/1990 | WIPO . |

*Primary Examiner*—William E. Wayner
*Attorney, Agent, or Firm*—Wenderoth, Lind & Ponack

[57] ABSTRACT

An apparatus and a method is provided for varying high side pressure in a transcritical vapor compression cycle by means of variable volume element(s) connected to a flow circuit thereof. A variable volume element having a compartment is connected to and communicates with the high side to permit entry of refrigerant into the compartment. A movable partition defines at least one side of the compartment and is displaceable between first and second positions respectively defining first and second volumes of refrigerant within the compartment.

11 Claims, 1 Drawing Sheet

TRANSCRITICAL VAPOR COMPRESSION CYCLE DEVICE WITH A VARIABLE HIGH SIDE VOLUME ELEMENT

FIELD OF INVENTION

This invention relates to vapor compression cycle devices, such as refrigerators, air-conditioning units and heat pumps, using a refrigerant operating in a closed circuit under transcritical conditions, and more particularly to means and a method for variably controlling high side pressure of these devices.

BACKGROUND OF THE INVENTION

The invention relates to transcritical vapor compression devices, one of which is the subject of European patent application No. 89910211.5.

Standard subcritical vapor compression technology requires an operating pressure and temperature well below the critical values of a particular refrigerant. Transcritical vapor compression cycles exceed the critical pressure in the high side of the flow circuit. Since the most important object of the invention is to provide an apparatus and a method facilitating the use of alternatives to environmentally unacceptable refrigerants, the background for the invention is best explained in view of developments from standard vapor compression technology.

The basic components of a single-stage vapor compression system consist of a compressor, a condenser, a throttling or expansion valve, and an evaporator. These basic components may be supplemented with a liquid-to-suction heat exchanger.

The basic subcritical cycle operates as follows. A liquid refrigerant partly vaporizes and cools as its pressure is reduced in the throttling valve. Entering the evaporator, the mixed liquid-vapor refrigerant absorbs heat from a fluid being cooled and the refrigerant boils and completely vaporizes. The low-pressure vapor is then drawn into a compressor, where the pressure is raised to a point where the superheated vapor can be condensed by the available cooling media. The compressed vapor then flows into the condenser, where the vapor cools and liquefies as the heat is transferred to air, water or another cooling fluid. The liquid then flows to the throttling valve.

The term "transcritical cycle" denotes a refrigeration cycle operating partly below and partly above the refrigerant's critical pressure. In the supercritical region, pressure is more or less independent of temperature since there is no longer any saturation condition. Pressure can therefore be freely chosen as a design variable. Downstream from the compressor outlet, the refrigerant is cooled at mainly constant pressure by heat exchange with a coolant. The cooling gradually increases the density of the single phase refrigerant.

A change in volume and/or instant refrigerant charge in the high side affects the pressure, which is determined by the relation between the instant charge and the volume.

In contrast, subcritical systems operate below the refrigerant's critical point and therefore operate with two phase conditions in the condenser, saturated liquid and vapor. A change in the volume of the high side will not directly affect the equilibrium saturation pressure.

In transcritical cycles the high side pressure can be modulated to control capacity or to optimize the coefficient of performance, and the modulation is done by regulating the refrigerant charge and/or regulating the total internal high side volume of the system.

WO-A-90/07683 discloses one of these options for control of the supercritical high side pressure, namely variation of the instant refrigerant charge in the high side of the circuit.

From DE-C-898 751 it is known to apply a high pressure liquid accumulator in order to maintain the refrigerating capacity and to even out the low side temperature fluctuations during the compressor off periods. The disclosure is related to the system operating at subcritical high side pressure having different purpose and mechanism compared to the present control of the supercritical high side pressure.

OBJECTS OF THE PRESENT INVENTION

An object of the present invention is to provide an apparatus and a method for varying the volume in the high side of a transcritical vapor compression system in order to control pressure in the high side of the system.

Another object of the present invention is to provide an apparatus and a method for compensating for effects of refrigerant leakage.

Still another object of the present invention is to provide a variable volume element operatively connectable to a conventional hydraulic system of, for example, a motor vehicle in order to vary the high side volume of a transcritical vapor compression system.

A further object of the present invention is to provide a variable volume element integratable into any control system for high side pressure optimization or capacity control in a transcritical vapor compression system.

Another further object of the invention is to provide equipment for reducing pressure while the transcritical system is not operating, and thereby facilitate weight and material savings since the low side could be designed for lower pressure tolerance.

A still further object of the present invention is to provide means and a method for air-conditioning a car while dispensing with the use of environmentally unacceptable refrigerants.

BRIEF DESCRIPTION OF THE DRAWINGS

Several apparatus embodiments of the inventive concept are illustrated in attached FIGS. 1–4 in which.

DESCRIPTION OF THE PREFERRED EMBODIMENTS

Figure 1:
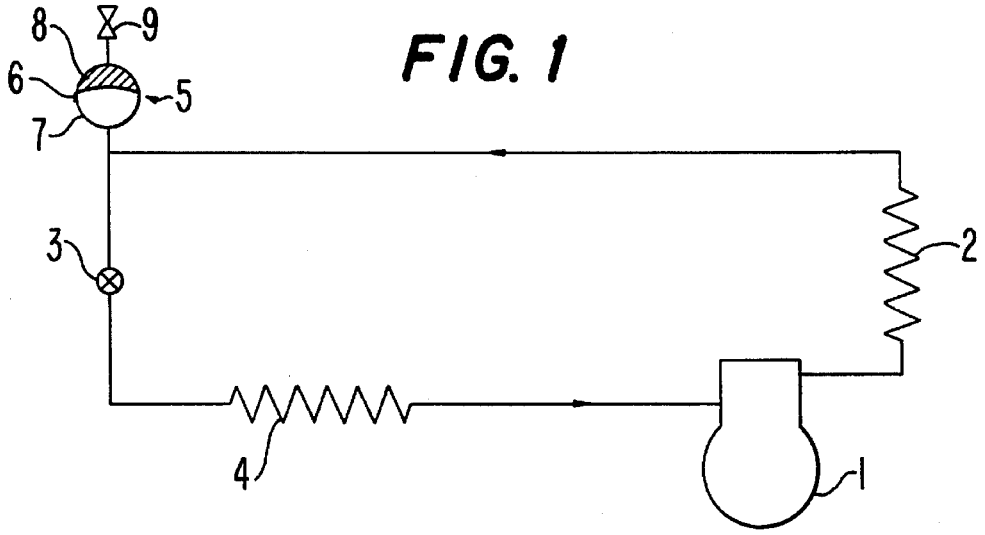
FIG. 1 is a schematic representation of a transcritical vapor compression system with a pressure vessel containing an internal flexible membrane movable in response to varying pressure of an extra-systemic medium occupying the hatched portion of the pressure vessel.

FIG. 1 shows the basic components of a transcritical vapor compression system incorporating the inventive apparatus and operating in accordance with the inventive method. Following the flow circuit of the system, a compressor 1 leads to a gas cooler or heat exchanger 2. The inventive variable volume element 5 is connected in the high side of the flow circuit and more particularly between the outlet of a compressor 1 and the inlet of a throttling valve 3 of a conventional type, e.g. a thermostatic valve as indicated. The refrigerant flows further to an evaporator 4 and then back to the compressor inlet.

The variable volume element 5 is to be positioned between the compressor 1 and the throttling valve 3, but need not be positioned exactly as schematically represented in FIG. 1. In the preferred embodiment shown in FIG. 1, variable volume element 5 has the structure of a conventional pressure vessel.

The variable volume element 5 contains an internal flexible membrane or partition 6 of conventional construction. The membrane 6 is movably contiguous or flush with interior surface portions of the variable volume element 5 so as to divide its interior into two non-communicating compartments 7,8, the relative volumes of which are determined by positioning of the membrane 6.

In the preferred embodiment of the invention, the membrane or partition 6 is continuously displaceable within the interior of the variable volume element 5 so as to continuously change the relative volumes of compartments 7 and 8. While the inventive concept also extends to non-continuous displacement of the membrane 6, stageless or continuous adjustment of the position of the membrane 6 permits more flexible and efficient control than stepwise adjustment.

Compartment 8 is in communication with a valve 9 connected to a hydraulic system (not shown). Valve 9 can control amounts of any fluid, preferably hydraulic oil, within compartment 8. It is convenient but not necessary that hydraulic oil or hydraulic systems be used to impel movement of the flexible membrane 6. Mechanical means connected to the membrane 6 or pressurized means connected to the variable volume element 5, for example pressurized gas filling compartment 8 or even spring-actuated pressure, for displacing the membrane or partition 6 are within the inventive concept.

When valve 9 admits controlled amounts of hydraulic oil into compartment 8, the oil presses against the flexible membrane 6 and pushes it away from valve 9 so as to thereby diminish (thus regulating) the volume of compartment 7.

Compartment 7 communicates with the high side of the flow circuit of the transcritical vapor compression system. As hydraulic oil is admitted into compartment 8 to thereby reduce the volume of compartment 7, refrigerant within compartment 7 is forced out of compartment 7 in proportion to the reduction of its volume.

This expulsion of refrigerant from compartment 7 increases the high side pressure of the vapor compression system. As hydraulic oil is withdrawn through valve 9 from the compartment 8, the pressure of oil within compartment 8 lowers such that it can no longer press membrane 6 as far from the valve 9 as previously.

Refrigerant flows from the flow circuit into compartment 7 as the membrane 6 moves to an interior circumferentially extending position nearer to valve 9. The volume of compartment 7 then is increased, while the volume of compartment 8 is decreased. Meanwhile, the high side pressure of the flow circuit has been reduced.

FIGS. 2, 3 and 4*a*–4*b* show alternate embodiments for the variable volume element 5. The above-detailed description for variable volume element 5 and its function as shown in FIG. 1 is equally applicable to the embodiments shown in FIGS. 2–4*b* with appropriate modification in consideration of the varying embodiments.

Figure 2:
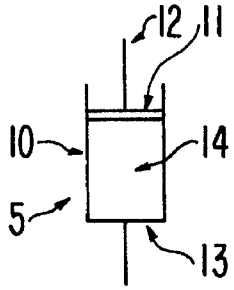
FIG. 2 is a schematic representation of an alternate piston-containing embodiment of a variable volume element.

FIG. 2 shows variable volume control element 5 in the form of a cylinder 10 having a head 13. A piston rod 12 is connected at one end to a control mechanism (not shown), and at its other end has a piston 11 closely fitted in the cylinder 10 and movable back and forth or up and down in response to the position of the control mechanism. A compartment 14 is definable within the interior of the cylinder 10 by the distance between the cylinder head 13 and the top of piston 11, the top being that surface of the piston facing the cylinder head 13.

Compartment 14 communicates with the high side of the flow circuit of the vapor compression system such that the compartment's volume is occupied by refrigerant.

The pictured embodiments of the variable volume element 5 are shown in FIGS. 1 and 2 in a position branching off from the main flow circuit between the compressor 1 and the throttling valve 3. This positioning of these embodiments laterally or to one side of the flow circuit is operationally convenient in view of the form and function of the embodiments. As positioned, these pictured embodiments offer the possibility of volume control without directly altering the volume of the tubes themselves along the main flow circuit. However, it is within the inventive concept to position the embodiments of FIGS. 1 and 2 directly within the main flow circuit between compressor 1 and throttling valve 3.

Figure 3:
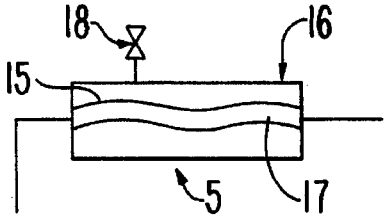
FIG. 3 is a schematic representation of a third embodiment of a variable volume element with the element being a flexible hose surrounded by hydraulic oil, and FIGS. 4*a,b* schematically illustrate still another embodiment of the variable volume element as bellows attached to or incorporated in a flow circuit, respectively.

The embodiment pictured in FIG. 3 suggests the possibility of positioning a variable volume element 5 directly along the flow circuit, though element 5 may in accordance with the inventive concept also be located at a position generally lateral to the flow circuit. FIG. 3 shows the variable volume element 5 in the form of a flexible hose 15 connecting and communicating with portions of the main flow circuit and being enclosed by a sealed compartment 16 containing hydraulic oil or some other pressurized fluid. The sealed compartment 16 does not prevent communication between the hose 15 and the main flow circuit, and does not communicate with the interior compartment 17 of hose 15. Compartment 16 is preferably inflexible. In its position, the hose 15 can in response to pressure from the hydraulic oil passing through valve 18 be constricted or expanded so as to be varied in volume. Conceivably, this embodiment offers the best opportunity to avoid trapping of lubricant.

Figure 4A:
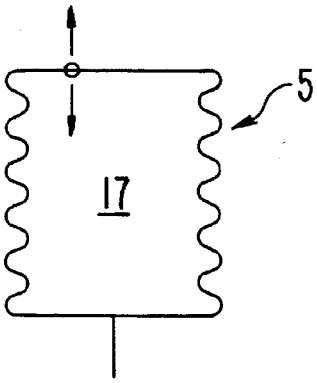
Figure 4B:
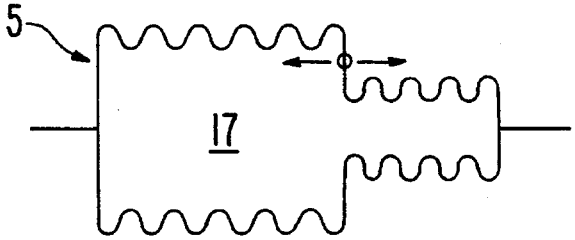

Other variable volume elements such as e.g. bellows may also be applied as schematically illustrated in FIGS. 4*a* and 4*b*. The variable volume element 5 is shown as bellows of variable internal volume (compartment) 17 when exposed to a mechanical control mechanism/displacement means or a varying pressure from an external medium (not shown), the bellows being either attached as a branch to the flow circuit (FIG. 4*a*) or positioned in series as an integrated part of the flow circuit (FIG. 4*b*).

The inventive concept is also expressed in terms of a procedure for varying high side volume within a transcritical vapor compression flow circuit carrying a refrigerant successively downstream from a compressor 1 through a heat exchanger 2 and to a throttling valve 3. The procedure comprises connecting a volume control element 5 to the flow circuit at a location between the compressor 1 and the throttling valve 3, arranging a compartment 7,14,17 within the element 5 so that the compartment 7,14,17 communicates with the flow circuit at the location, fitting a movable partition 6,11,15 within the element 5 and thereby defining at least one side of the compartment 7,14,17 within the element, the partition 6,11,15 being displaceable between a first position defining a first volume for the compartment 7,14,17 and a second position defining a second volume greater than the first volume, connecting displacing means 9,12,18 so that they are in communication or in engagement with the partition 6,11,15, and displacing the partition 6,11, 15 between the first and second positions by operating the displacement means 9,12,18. In a preferred embodiment of the inventive method, the step of displacing is performed continuously.

By controlling the internal volume of the variable volume element 5, the high side pressure of the transcritical vapor compression unit is controlled. This control is effected by varying the mechanical displacement of the partition 6,11,15 or the amount of extra-systemic pressurized fluid (that is, fluid not undergoing at any time vapor compression) acting to press refrigerant out of the variable volume element 5. If installed in a car, the hydraulic system of the car may be connected via a valve arrangement. This volume regulating system may be integrated into any control strategy for high side pressure optimization, capacity control, and capacity boosting.

The possibility of reduction of pressure during standstill or during non-operation is a particular advantage of the inventive concept. For example, if connected to a car's air conditioner, the inventive variable volume element (variously shaped as illustrated in the embodiments) can reduce pressure by increasing volume when the air conditioner is turned off. This is desirable because high temperatures in an engine compartment are transmitted to the inactive air conditioner, thereby increasing its pressure. By using the inventive variable volume element, the air conditioner's low side could be designed for lower pressure tolerance, thus saving material, capital and weight.

We claim:

1. An apparatus for control of the high side pressure in a vapor compression cycle device operating with super-critical high side pressure, comprising a compressor, a heat exchanger, an expansion means and an evaporator connected in series in a flow circuit, said apparatus comprising at least one variable volume element having a compartment connected to and in free communication with the flow circuit at a location between the compressor and the expansion means, a movable partition means defining at least one side of the compartment, the partition means being displaceable between first and second positions, respectively defining first and second volumes of refrigerant within the compartment, and means external to the flow circuit for displacing the partition means between the first and second positions to thereby change and control refrigerant volume within the compartment.

2. The apparatus according to claim 1, wherein the volume element defines a hollow interior, the partition is a flexible membrane movably contiguous with circumferentially extending interior surface portions of the interior so as to divide the interior and define a first compartment and a second compartment, being noncommunicating and having relative volumes determined by positioning of the partition, exposed to pressurized means in communication with the second compartment.

3. The apparatus according to claim 2, wherein the displacement means comprise a hydraulic or pneumatic means communicating with the partition means.

4. The apparatus according to claim 1, wherein the volume element comprises a cylinder defining a hollow interior, and a piston, the piston being closely fitted within the cylinder and displaceable through the interior forming the partition means.

5. The apparatus according to claim 3, wherein the displacement means comprise a hydraulic or pneumatic means communicating with the partition means.

6. The apparatus according to claim 1, wherein the compartment is completely defined by the movable partition means.

7. The apparatus according to claim 6, wherein the movable partition means is a flexible hose.

8. The apparatus according to claim 6, wherein the movable partition means is a bellows arrangement.

9. The apparatus according to claim 4, wherein the displacement means comprise a hydraulic or pneumatic means communicating with the partition means.

10. The apparatus according to claim 1, wherein the partition means is continuously displaceable.

11. A method of varying high side pressure in a vapor compression cycle device operating at supercritical pressure in the high side of a flow circuit carrying a refrigerant successively from a compressor through a heat exchanger and to an expansion means, said method comprising regulating the supercritical high side pressure by subjecting the total internal volume of the high side of the flow circuit to controlled variation by means of one or several variable volume elements connected to the flow circuit at a location between the compressor and the expansion means, said elements comprising a compartment of variable volume freely communicating with the flow circuit.

* * * * *